US008607394B1

(12) United States Patent
Liao

(10) Patent No.: US 8,607,394 B1
(45) Date of Patent: Dec. 17, 2013

(54) ROTATION TYPE TOOTHBRUSH

(75) Inventor: Jin-Po Liao, Taichung (TW)

(73) Assignee: Jin-Po Liao, Taichung (TW)

( * ) Notice: Subject to any disclaimer, the term of this patent is extended or adjusted under 35 U.S.C. 154(b) by 0 days.

(21) Appl. No.: 13/603,058

(22) Filed: Sep. 4, 2012

(51) Int. Cl.
*A46B 13/08* (2006.01)

(52) U.S. Cl.
USPC ..... 15/28; 15/22.1

(58) Field of Classification Search
USPC ..... 15/22.1, 25, 26, 28
See application file for complete search history.

(56) References Cited

U.S. PATENT DOCUMENTS 4,783,869 A * 11/1988 Lee ..... 15/22.1
5,120,225 A * 6/1992 Amit ..... 433/216
5,715,556 A * 2/1998 Chung ..... 15/22.1
6,098,230 A * 8/2000 Zseng ..... 15/22.1
6,148,462 A * 11/2000 Zseng ..... 15/22.1
6,453,499 B1 * 9/2002 Leuermann ..... 15/28
2004/0068810 A1 * 4/2004 Lee ..... 15/22.1
2008/0104781 A1 * 5/2008 Denney et al. ..... 15/28

* cited by examiner

*Primary Examiner* — Mark Spisich
(74) *Attorney, Agent, or Firm* — Tracy M. Heims; Apex Juris, pllc

(57) ABSTRACT

A rotation type toothbrush has a handle set, a brush-head set and a transmitting set. The handle set has a handle, a mounting sleeve and a positioning mount. The handle has a locating recess. The mounting sleeve is connected to the handle. The positioning mount is securely mounted in the locating recess, abuts against the mounting sleeve and has a limiting recess and a holding hole. The brush-head set is connected to the handle set and has a sliding shaft and a rotating head. The sliding shaft is movably connected to the mounting sleeve and has a connecting tube, an operating head and a through slot. The rotating head is mounted on the operating head and has a mounting board and a gear wheel. The transmitting set is connected to the handle set and the brush-head set and has a rack, a pushing block and two elastic elements.

19 Claims, 8 Drawing Sheets

ROTATION TYPE TOOTHBRUSH

BACKGROUND OF THE INVENTION

1. Field of the Invention

The present invention relates to a rotation type toothbrush, and more particularly to a rotation type toothbrush that can improve the cleaning effect of the toothbrush without using electric power and can save the cost of manufacturing the toothbrush.

2. Description of Related Art

A conventional toothbrush is used to clean the user's teeth; the user can hold and move the conventional toothbrush left and right or up and down relative to the user's teeth by hands to clean the user's teeth, or the user can use a conventional electric toothbrush to provide a cleaning effect to the user's teeth. However, the cleaning effect of the conventional toothbrush is not sufficient due to incorrect operation of the conventional toothbrush or poor brushing habits of the users. In addition, though the cleaning effect of the conventional electric toothbrush is sufficient enough by a rotating brush head, the cost of manufacturing the conventional electric toothbrush is higher than that of manufacturing the conventional toothbrush. Therefore, how to strike a balance between the conventional toothbrush and the conventional electric toothbrush needs to be considered and resolved.

To overcome the shortcomings, the present invention provides a rotation type toothbrush to mitigate or obviate the aforementioned problems.

SUMMARY OF THE INVENTION

The main objective of the present invention is to provide a rotation type toothbrush that can improve the cleaning effect of the toothbrush without using electric power and can save the cost of manufacturing the toothbrush.

The rotation type toothbrush in accordance with the present invention has a handle set, a brush-head set and a transmitting set. The handle set has a handle, a mounting sleeve and a positioning mount. The handle has a locating recess. The mounting sleeve is connected to the handle. The positioning mount is securely mounted in the locating recess, abuts against the mounting sleeve and has a limiting recess and a holding hole. The brush-head set is connected to the handle set and has a sliding shaft and a rotating head. The sliding shaft is movably connected to the mounting sleeve and has a connecting tube, an operating head and a through slot. The rotating head is mounted on the operating head and has a mounting board and a gear wheel. The transmitting set is connected to the handle set and the brush-head set and has a rack, a pushing block and two elastic elements.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
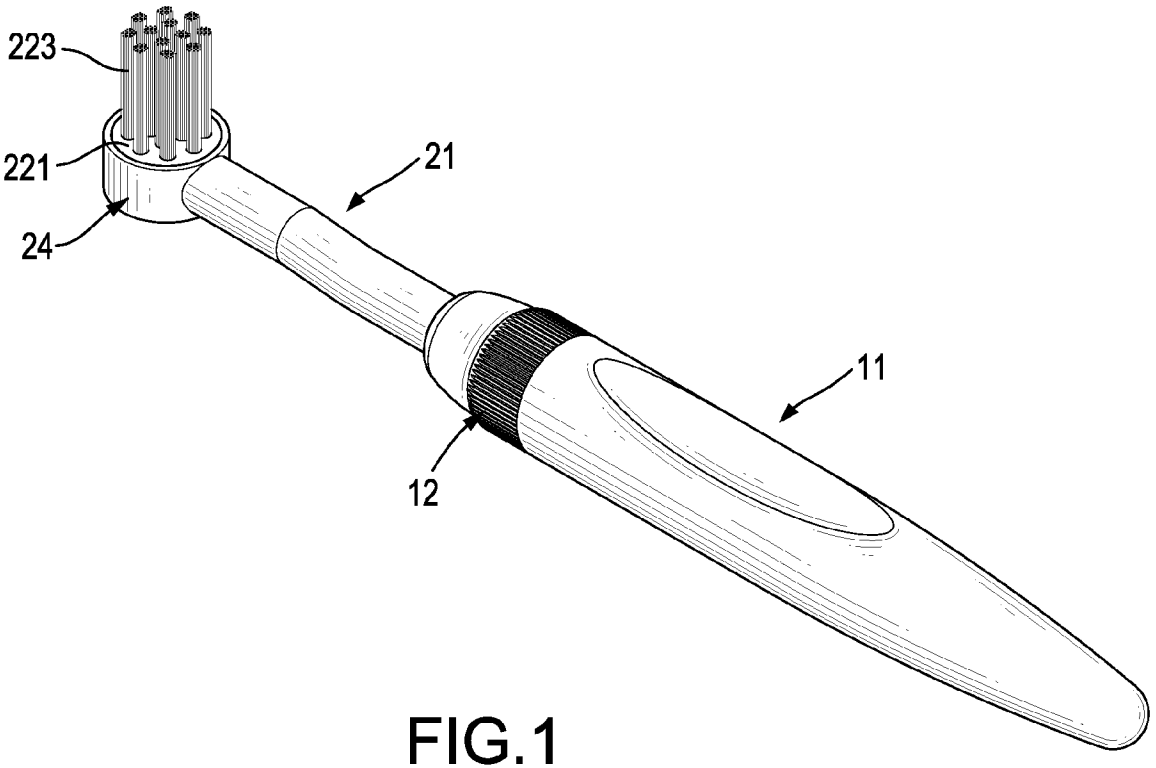
FIG. 1 is a perspective view of a first embodiment of a rotation type toothbrush in accordance with the present invention.
Figure 2:
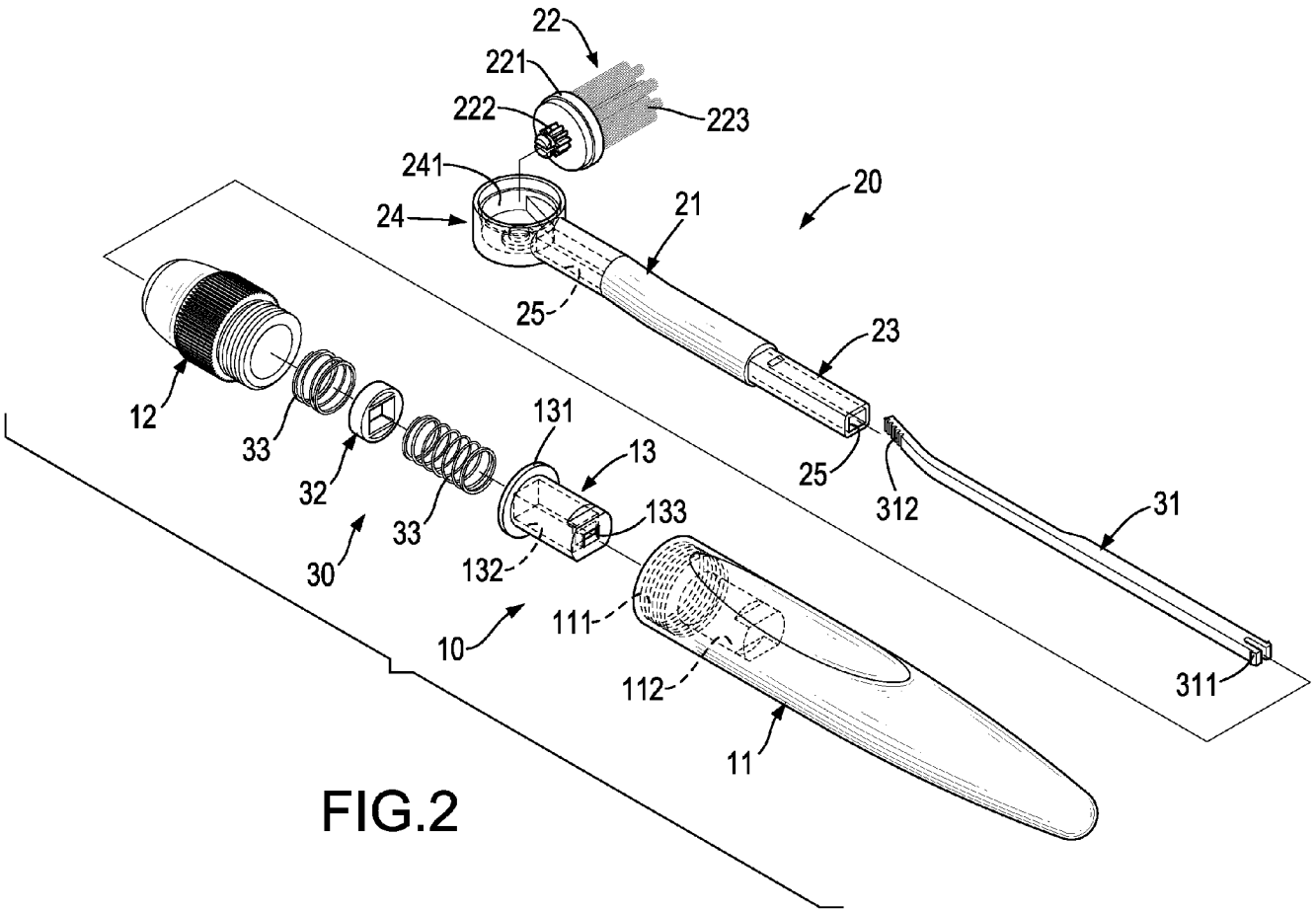
FIG. 2 is an exploded perspective view of the rotation type toothbrush in FIG. 1.
Figure 3:
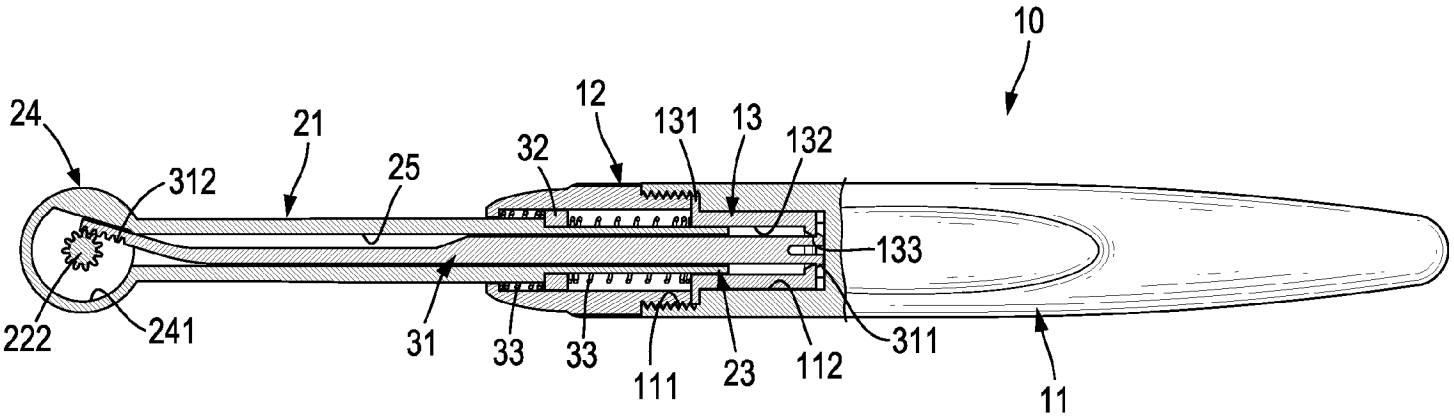
FIG. 3 is a side view in partial section of the rotation type toothbrush in FIG. 1.

With reference to FIGS. 1 to 3, a first embodiment of a rotation type toothbrush in accordance with the present invention has a handle set 10, a brush-head set 20 and a transmitting set 30.

The handle set 10 has a handle 11, a mounting sleeve 12 and a positioning mount 13.

The handle 11 has a front end, a rear end, a threaded recess 111 and a locating recess 112. The threaded recess 111 is formed through the front end of the handle 11. The locating recess 112 is formed in the handle 11 near the front end of the handle and communicates with the threaded recess 111. The mounting sleeve 12 is hollow, is detachably connected to the handle 11 and has a rear end and a front end. The rear end of the mounting sleeve 12 is mounted in the front end of the handle 11 and is screwed in the threaded recess 111 of the handle 11.

The positioning mount 13 is securely mounted in the locating recess 112 of the handle 11 via the threaded recess 111, abuts against the rear end of the mounting sleeve 12 and has a front end, a rear end, a holding flange 131, a limiting recess 132 and a holding hole 133. The front end of the positioning mount 13 abuts the rear end of the mounting sleeve 12. The holding flange 131 is formed around the positioning mount 13 at the front end of the positioning mount 13, is mounted in the threaded recess 111 and abuts against the rear end of the mounting sleeve 12. The limiting recess 132 may be quadrate and is formed in the front end of the positioning mount 13. The holding hole 133 is formed through the rear end of the positioning mount 13 and communicates with the limiting recess 132 and the locating recess 112.

The brush-head set 20 is detachably connected to the handle set 10 and has a sliding shaft 21 and a rotating head 22.

The sliding shaft 21 is movably connected to the mounting sleeve 12 and has a rear end, a front end, a connecting tube 23, an operating head 24 and a through slot 25. The rear end of the sliding shaft 21 is mounted in the mounting sleeve 12. The connecting tube 23 is formed on the rear end of the sliding shaft 21, is securely mounted in the limiting recess 132 of the positioning mount 13 via the mounting sleeve 12 and has a shape corresponding to a shape of the limiting recess 132 to enable the sliding shaft 21 to move relative to the positioning mount 13 without rotating.

Figure 6:
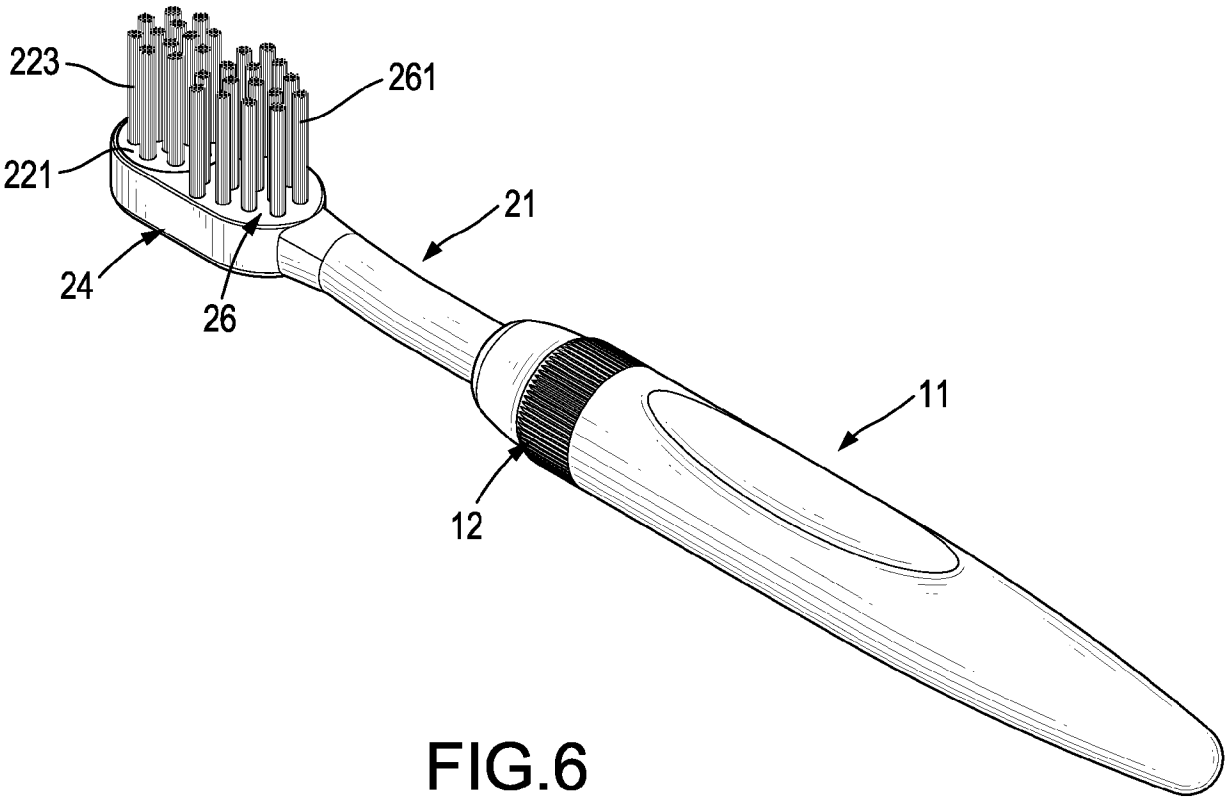
FIG. 6 is a perspective view of a second embodiment of a rotation type toothbrush in accordance with the present invention.
Figure 7:
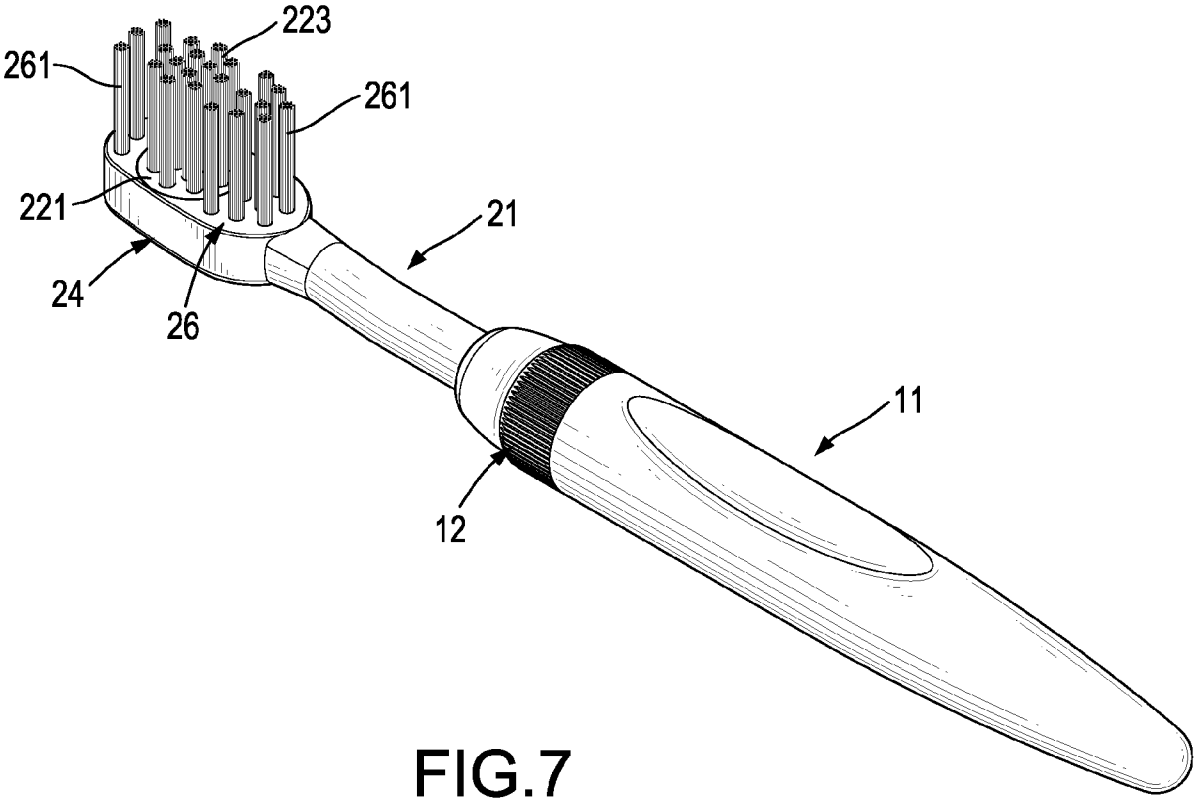
FIG. 7 is a perspective view of a third embodiment of a rotation type toothbrush in accordance with the present invention.
Figure 8:
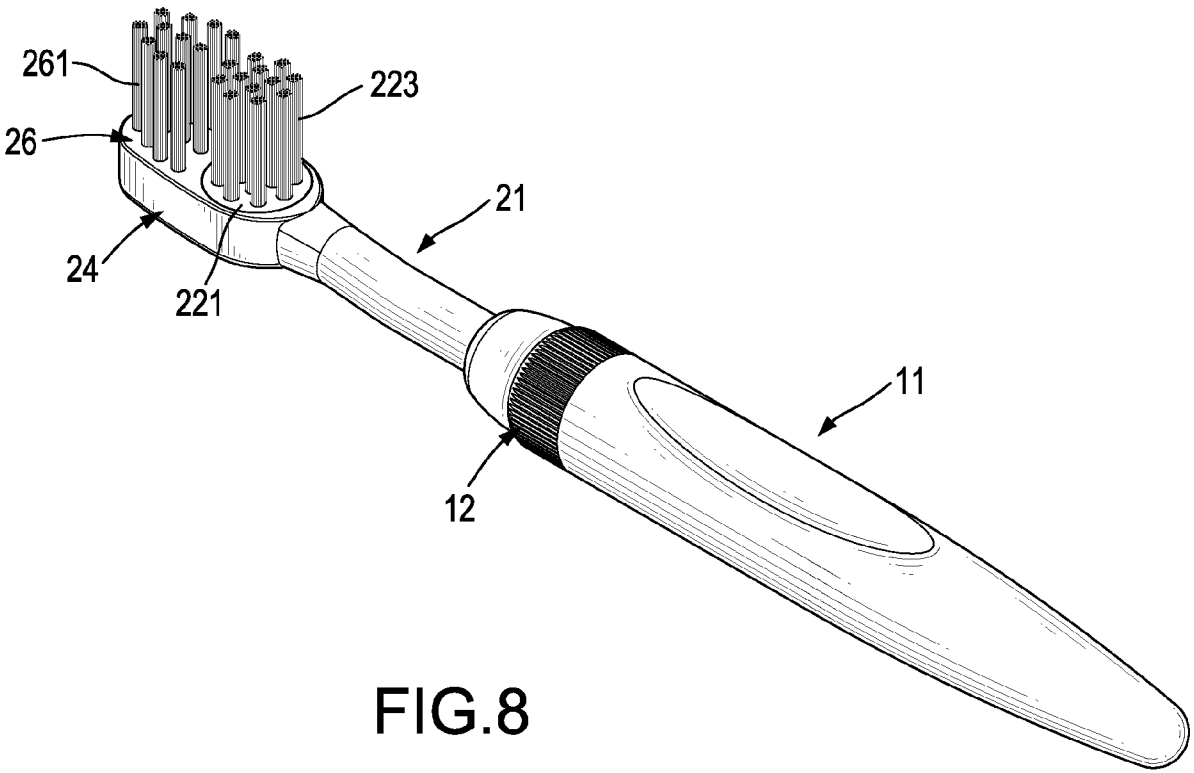
FIG. 8 is a perspective view of a fourth embodiment of a rotation type toothbrush in accordance with the present invention.

The operating head 24 is annular, is formed on the front end of the sliding shaft 21 and has a driving recess 241 formed in the operating head 24. Preferably, the operating head 24 may be circular as shown in FIG. 1 or may be elongated elliptical as shown in FIGS. 6 to 8. The through slot 25 is formed through the sliding shaft 21 and the connecting tube 23 and communicates with the driving recess 241 of the operating head 24 and the limiting recess 132 of the positioning mount 13.

The rotating head 22 is rotatably mounted on the operating head 24 of the sliding shaft 21 and has a mounting board 221, a gear wheel 222 and multiple bristles 223. The mounting board 221 is rotatably mounted on the operating head 24 to cover the driving recess 241 and has a bottom face and a top face. The gear wheel 222 is formed on and protrudes from the bottom face of the mounting board 221 and is mounted in the driving recess 241 of the operating head 24. The bristles 223 are mounted on and protrude from the top face of the mounting board 221 at intervals.

Preferably, with reference to FIGS. 6 to 8, when the operating head 24 is elongated elliptical, the brush-head set 20 has a top panel 26 mounted on the operating head 24 and around the mounting board 221 of the rotating head 22 and having a front end, a middle, a rear end, a top face and multiple fixing bristles 261. The fixing bristles 261 are mounted on and protrude from the top face of the top panel 26 at intervals. Furthermore, the mounting board 221 of the rotating head 22 can be rotatably mounted in the front end, the middle or the rear end of the top panel 26 as shown in FIGS. 6, 7 and 8.

The transmitting set 30 is connected to the handle set 10 and the brush-head set 20 and has a rack 31, a pushing block 32 and two elastic elements 33.

The rack 31 is mounted in the positioning mount 13 and the sliding shaft 21 and has a straight rear end, a curved front end, two hooks 311 and multiple engaging teeth 312. The straight rear end of the rack 31 is mounted in the limiting recess 132 of the positioning mount 13 via the connecting tube 23 and extends in the locating recess 112 via the holding hole 133. The curved front end of the rack 31 extends into the driving recess 241 of the operating head 24 via the through slot 25 of the sliding shaft 21. The hooks 311 are formed on the straight rear end of the rack 31 and extend through the holding hole 133 to engage the positioning mount 13 to prevent the rack 31 from moving relative to the sliding shaft 21. The engaging teeth 312 are formed on and protrude from the curved front end of the rack 31 and engage the gear wheel 222 of the rotating head 22.

The pushing block 32 is securely mounted around the connecting tube 23 of the sliding shaft 21 and is mounted in the mounting sleeve 12. The elastic elements 33 are respectively mounted around the sliding shaft 21 and the connecting tube 23 in the mounting sleeve 12, and one of the elastic elements 33 abuts the front end of the mounting sleeve 12 and the pushing block 32 and the other elastic element 33 abuts the pushing block 32 and the holding flange 131 of the positioning mount 13.

Figure 4:
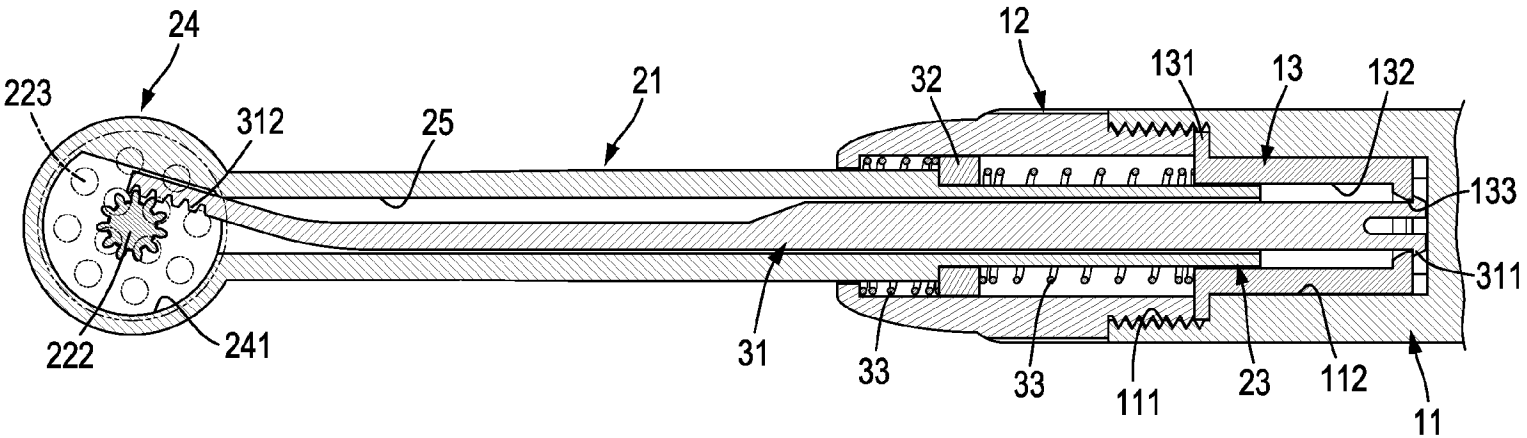
FIG. 4 is an enlarged cross sectional side view of the rotation type toothbrush in FIG. 3.
Figure 5:
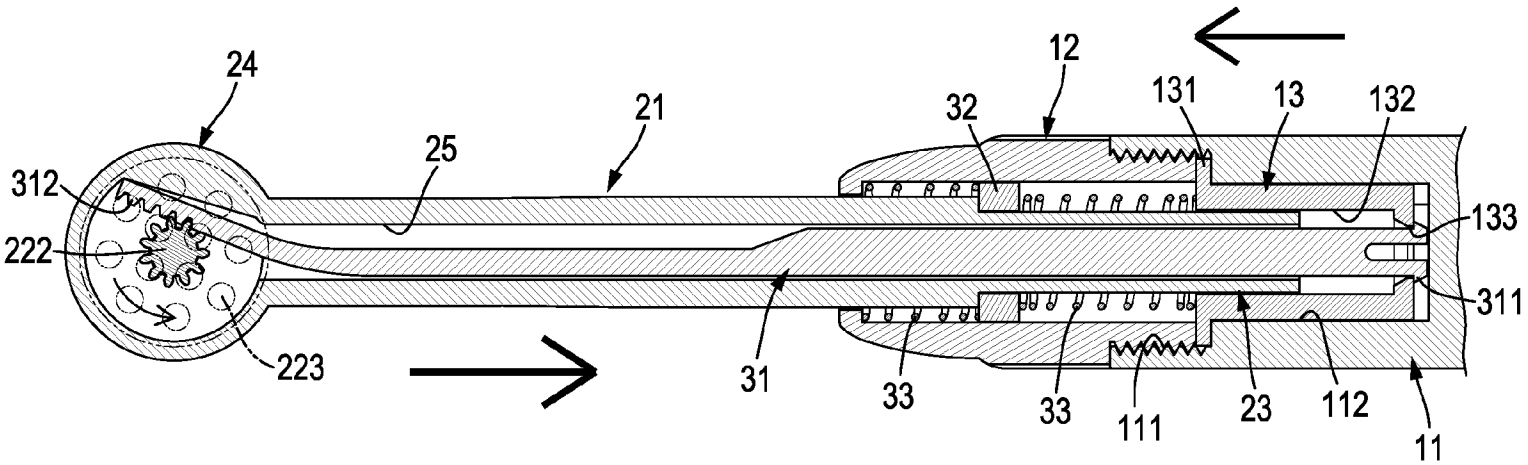
FIG. 5 is an operational and enlarged cross sectional side view of the rotation type toothbrush in FIG. 4.

With reference to FIGS. 4 and 5, when a user holds the rotation type toothbrush in accordance with the present invention to clean the user's teeth, the handle 11 is held by the user's hand to enable the brush-head set 20 to move in a leftward or rightward direction relative to the user's teeth. With reference to FIG. 5, the user moves the handle 11 in a leftward direction. The bristles 223 abut against the user's cheek and teeth to provide a force to compress the sliding shaft 21. Then, the sliding shaft 21 will move relative to the transmitting set 30 and the handle 11 in an opposite direction (rightward direction as shown in FIG. 5) to enable the rear end of the sliding shaft 21 to move inward the mounting sleeve 12 to compress one of the elastic elements 33 by the pushing block 32. In the above-mentioned operation, because the shape of the connecting tube 23 is corresponding to the shape of the limiting recess 132 of the positioning mount 13, the sliding shaft 21 can move relative to the handle 11 without rotating. At present, the engaging teeth 312 of the rack 31 can be moved relative to the driving recess 241 by the opposite movement of the sliding shaft 21 to enable the gear wheel 222 to rotate in a counterclockwise direction relative to the operating head 24 as shown in FIG. 5. When the gear wheel 222 is rotated relative to the operating head 24, the mounting board 221 and the bristles 223 will rotate with the gear wheel 222 relative to the operating head 24 and this can enable the bristles 223 to clean the user's teeth in a rotating manner.

In addition, when the user moves the handle 11 in the leftward direction as shown in FIG. 5, one of the elastic elements 33 is compressed and the other elastic element 33 is extended. Then, when the handle 11 is moved in a rightward direction, the elastic forces of the elastic elements 33 can be used to move the pushing block 32 to return to the original position. Then, the sliding shaft 21 can be moved backward to the original position relative to the rack 31 by a pushing force of the pushing block 32, and this can enable the engaging teeth 312 to move relative to the gear wheel 222. When the engaging teeth 312 are moved relative to the gear wheel 222, the gear wheel 222 will be rotated in a clockwise direction to enable the bristles 223 to rotate in the clockwise direction to clean the user's teeth.

According to the above-mentioned operation, when the handle 11 of the rotation type toothbrush in accordance with the present invention is moved in the leftward or rightward direction, the sliding shaft 21 can be moved relative to the rack 31 and this can enable the engaging teeth 312 to move relative to the gear wheel 222. Then, the bristles 223 that are mounted on the mounting board 221 can be rotated in the counterclockwise or clockwise direction to clean the user's teeth without using electric power.

In addition, with reference to FIGS. 6 to 8, when the user uses the rotation type toothbrush that has the top panel 26 mounted on the operating head 24 and around the mounting board 221, the user moves the handle 11 in the leftward and rightward directions, the fixing bristles 261 that are formed on the top panel 26 will be moved in a line motion with the sliding shaft 21 and the bristles 223 that are formed on the mounting board 221 will be rotated in a counterclockwise and clockwise direction back and forth at the same time. Consequently, the rotation type toothbrush in accordance with the present invention can use the fixing bristles 261 to clean the user's teeth in a line motion and use the bristles 223 to clean the user's teeth in rotation at the same time and this can enable the rotation type toothbrush to provide a three-dimensional cleaning effect to the user's teeth to improve the cleaning effect of the toothbrush.

According to the above-mentioned structures and operations, the bristles 223 and the fixing bristles 261 of the rotation type toothbrush in accordance with the present invention abut against the user's cheek and teeth to enable the sliding shaft 21 to move relative to the handle 11 and to enable the rotating head 22 to rotate relative to the operating head 24 by the engagement between the gear wheel 222 and the engaging teeth 312 of the rack 31. Then, the bristles 223 of the rotating head 22 can be used to clean the user's teeth in a rotating manner and the fixing bristles 261 of the top panel 26 can be used to clean the user's teeth in a line motion, and this can enable the rotation type toothbrush to provide a three-dimensional cleaning effect to the user's teeth to improve the cleaning effect of the toothbrush. Furthermore, the features of the conventional toothbrush (linear brush) and the conventional electric toothbrush (rotating brush) are integrated into the rotation type toothbrush in accordance with the present invention, and the cost of manufacturing the rotation type toothbrush can be reduced and the user can use the rotation type toothbrush to clean teeth without using electric power.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rotation type toothbrush having:

a handle set having:

a handle having:

a front end;

a rear end;

a threaded recess formed through the front end of the handle; and a locating recess formed in the handle near the front end of the handle and communicating with the threaded recess;

a mounting sleeve being hollow, detachably connected to the handle and having:

a rear end mounted in the front end of the handle and screwed in the threaded recess of the handle; and a front end; and a positioning mount securely mounted in the locating recess of the handle via the threaded recess, abutting against the rear end of the mounting sleeve and having:

a front end abutting the rear end of the mounting sleeve;

a rear end;

a limiting recess formed in the front end of the positioning mount and having a shape; and a holding hole formed through the rear end of the positioning mount and communicating with the limiting recess and the locating recess;

a brush-head set detachably connected to the handle set and having:

a sliding shaft movably connected to the mounting sleeve and having:

a rear end mounted in the mounting sleeve;

a front end;

a connecting tube formed on the rear end of the sliding shaft, securely mounted in the limiting recess of the positioning mount via the mounting sleeve and having a shape corresponding to the shape of the limiting recess to enable the sliding shaft to move relative to the positioning mount without rotating;

an operating head formed on the front end of the sliding shaft and having a driving recess formed in the operating head; and a through slot formed through the sliding shaft and the connecting tube and communicating with the driving recess of the operating head and the limiting recess of the positioning mount; and a rotating head rotatably mounted on the operating head of the sliding shaft and having:

a mounting board rotatably mounted on the operating head to cover the driving recess and having a bottom face and a top face;

a gear wheel formed on and protruding from the bottom face of the mounting board and mounted in the driving recess of the operating head; and multiple bristles mounted on and protruding from the top face of the mounting board at intervals; and a transmitting set connected to the handle set and the brush-head set and having:

a rack mounted in the positioning mount and the sliding shaft and having:

a straight rear end mounted in the limiting recess of the positioning mount via the connecting tube and held in the holding hole of the positioning mount;

a curved front end extending into the driving recess of the operating head via the through slot of the sliding shaft; and multiple engaging teeth formed on and protruding from the curved front end of the rack and engaging the gear wheel of the rotating head;

a pushing block securely mounted around the connecting tube of the sliding shaft and mounted in the mounting sleeve; and two elastic elements respectively mounted around the sliding shaft and the connecting tube in the mounting sleeve, and one of the elastic elements abutting the front end of the mounting sleeve and the pushing block and the other elastic element abutting the pushing block and the front end of the positioning mount.

2. The rotation type toothbrush as claimed in claim 1, wherein the positioning mount has a holding flange formed around the positioning mount at the front end of the positioning mount, mounted in the threaded recess and abutting against the rear end of the mounting sleeve; and one of the elastic elements abuts the pushing block and the holding flange of the positioning mount.

3. The rotation type toothbrush as claimed in claim 2, wherein the operating head is elongated elliptical; and the brush-head set has a top panel mounted on the operating head, and around the mounting board of the rotating head and having a front end, a middle, a rear end, a top face and multiple fixing bristles mounted on and protruding from the top face of the top panel at intervals.

4. The rotation type toothbrush as claimed in claim 3, wherein the mounting board of the rotating head is rotatably mounted in the front end of the top panel.

5. The rotation type toothbrush as claimed in claim 4, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

6. The rotation type toothbrush as claimed in claim 3, wherein the mounting board of the rotating head is rotatably mounted in the middle of the top panel.

7. The rotation type toothbrush as claimed in claim 6, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

8. The rotation type toothbrush as claimed in claim 3, wherein the mounting board of the rotating head is rotatably mounted in the rear end of the top panel.

9. The rotation type toothbrush as claimed in claim 8, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

10. The rotation type toothbrush as claimed in claim 3, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

11. The rotation type toothbrush as claimed in claim 2, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

12. The rotation type toothbrush as claimed in claim 1, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

13. The rotation type toothbrush as claimed in claim 1, wherein the operating head is elongated elliptical; and the brush-head set has a top panel mounted on the operating head, and around the mounting board of the rotating head and having a front end, a middle, a rear end, a top face and multiple fixing bristles mounted on and protruding from the top face of the top panel at intervals.

14. The rotation type toothbrush as claimed in claim 13, wherein the mounting board of the rotating head is rotatably mounted in the front end of the top panel.

15. The rotation type toothbrush as claimed in claim 14, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

16. The rotation type toothbrush as claimed in claim 13, wherein the mounting board of the rotating head is rotatably mounted in the middle of the top panel.

17. The rotation type toothbrush as claimed in claim 16, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

18. The rotation type toothbrush as claimed in claim 13, wherein the mounting board of the rotating head is rotatably mounted in the rear end of the top panel.

19. The rotation type toothbrush as claimed in claim 18, wherein the straight rear end of the rack extends in the locating recess via the holding hole; and the rack has two hooks formed on the straight rear end of the rack and extending through the holding hole to engage the positioning mount to prevent the rack from moving relative to the sliding shaft.

* * * * *